US010316610B2

(12) United States Patent
Anderson et al.

(10) Patent No.: US 10,316,610 B2
(45) Date of Patent: Jun. 11, 2019

(54) DOWNHOLE PACKER AND ASSOCIATED METHODS

(71) Applicant: Swellfix B.V., Rijswijk (NL)

(72) Inventors: Neil Anderson, Aberdeen (GB); Colin Mackie, Aberdeen (GB)

(73) Assignee: Swellfix B.V., Rijswijk (NL)

( * ) Notice: Subject to any disclaimer, the term of this patent is extended or adjusted under 35 U.S.C. 154(b) by 196 days.

(21) Appl. No.: 15/037,845

(22) PCT Filed: Jan. 21, 2015

(86) PCT No.: PCT/EP2015/051143
§ 371 (c)(1),
(2) Date: May 19, 2016

(87) PCT Pub. No.: WO2015/110471
PCT Pub. Date: Jul. 30, 2015

(65) Prior Publication Data

US 2016/0312568 A1 Oct. 27, 2016

(30) Foreign Application Priority Data

Jan. 21, 2014 (GB) ..... 1400975.7

(51) Int. Cl.
*E21B 33/12* (2006.01)

(52) U.S. Cl.
CPC ..... *E21B 33/1208* (2013.01)

(58) Field of Classification Search
CPC ..... E21B 33/12; E21B 33/1208
See application file for complete search history.

(56) References Cited

U.S. PATENT DOCUMENTS

| | | | | |
|---|---|---|---|---|
| 4,410,040 | A | 10/1983 | Longacre et al. | |
| 4,457,369 | A | 7/1984 | Henderson | |
| 5,309,993 | A * | 5/1994 | Coon | E21B 33/1208 166/115 |
| 2002/0121380 | A1 | 9/2002 | Doane et al. | |
| 2004/0123983 | A1 | 7/2004 | Cook et al. | |
| 2009/0159299 | A1 * | 6/2009 | Kratochvil | E21B 33/124 166/387 |
| 2010/0051294 | A1 | 3/2010 | Nutley et al. | |
| 2010/0155064 | A1 | 6/2010 | Nutley et al. | |
| 2010/0307771 | A1 | 12/2010 | McRobb et al. | |

(Continued)

FOREIGN PATENT DOCUMENTS

| | | | |
|---|---|---|---|
| AU | 2013263826 | A1 | 12/2013 |
| WO | WO-2008062177 | A1 | 5/2008 |

(Continued)

OTHER PUBLICATIONS

Search Report for Great Britain Application No. GB1400975.7 dated Aug. 4, 2014.

(Continued)

*Primary Examiner* — D. Andrews
(74) *Attorney, Agent, or Firm* — Harness, Dickey & Pierce, P.L.C.

(57) ABSTRACT

A downhole seal device and associated method, the seal device having a support member; first and second end members fixed to opposing ends of the support member; and an outer seal mounted on the support member. The seal device is configured for mounting on a pipeline or other elongate member.

14 Claims, 14 Drawing Sheets

(56) References Cited

U.S. PATENT DOCUMENTS

| | | | | |
|---|---|---|---|---|
| 2012/0061528 | A1* | 3/2012 | Roth | E21B 19/07 248/65 |
| 2012/0145412 | A1 | 6/2012 | Andersen et al. | |
| 2012/0145413 | A1 | 6/2012 | Nutley et al. | |
| 2012/0145414 | A1 | 6/2012 | Nutley et al. | |
| 2014/0306406 | A1 | 10/2014 | Hibberd | |
| 2014/0352983 | A1 | 12/2014 | McRobb et al. | |
| 2016/0130907 | A1* | 5/2016 | Lundgard | E21B 33/1208 166/387 |

FOREIGN PATENT DOCUMENTS

| | | | |
|---|---|---|---|
| WO | WO-2011/110819 | A2 | 9/2011 |
| WO | WO-2013095098 | A1 | 6/2013 |

OTHER PUBLICATIONS

International Search Report PCT/ISA/210 for International Application No. PCT/EP2015/051143 dated Oct. 23, 2015.
Written Opinion of the International Searching Authority PCT/ISA/237 for International Application No. PCT/EP2015/051143 dated Oct. 23, 2015.
Search Report for corresponding European Application No. 15700508.3 dated Nov. 16, 2017.
Examination Report for corresponding Australian Application No. 2015208185 dated Oct. 16, 2018.

* cited by examiner

DOWNHOLE PACKER AND ASSOCIATED METHODS

CROSS-REFERENCE TO RELATED APPLICATIONS

This application is a national phase under 35 U.S.C. § 371 of PCT International Application No. PCT/EP2015/051143 which has an International filing date of Jan. 21, 2015, which claims priority to Great Britain Application No. GB 1400975.7, filed Jan. 21, 2014, the entire contents of each of which are hereby incorporated by reference.

FIELD

Embodiments described herein relate generally to a downhole seal device such as a packer and an associated end member and methods for producing and installing downhole seal devices.

BACKGROUND

Downhole packers are commonly used for applications such as isolating zones in a wellbore. Such packers are typically in the form of sheathes that can be mounted on pipelines or other structures found in the wellbore. The packers may comprise swellable components that swell under the action of fluid to form a seal between the pipeline and the inside diameter of the wellbore or bore casing.

Important considerations in packer design include ease of installation and the quality and reliability of sealing provided by the packer, particularly in high pressure and deep bore operations.

STATEMENTS OF INVENTION

According to a first aspect of the invention is a downhole seal device such as a packer. The seal device may be configured to be mounted on a pipeline or other elongate structure. The seal device may be configured to seal between the pipeline or other structure and walls or casing of a borehole, hole, liner, tubular or conduit in which it is located.

The seal device may comprise a support member. The seal device may comprise at least one and preferably two end members, e.g. first and second end members. The first and second end members may be fixed or fixable to opposing ends of the support member. The opposing ends may comprise opposing ends in a longitudinal direction of the support member. The support member and/or end member(s) may be rigid. The support member may be rigidly fixed to the end member(s).

The seal device may comprise a unitary or one piece device. The support member and/or one or more end members may be comprised in a unitary or one-piece chassis. The support member may be welded, bonded, integral with, or otherwise fixed to the end member(s). For example, the support member may be welded to the end member(s) using a full circle weld.

By providing the seal device as a one-piece or unitary device, then the device may be made stronger and more robust and the risk of the device failing, for example when being run through a tortuous well path or during operation, may be reduced.

The seal device may comprise one or more outer seals. The outer seal(s) may be mounted on the support member and particularly may be mounted on an outer surface of the support member. The outer seal(s) may be bonded or otherwise fixed to the support member and/or end member(s), for example, by vulcanization. The outer seal(s) may be arranged to face toward and seal against the borehole walls, liner, conduit, tubular or casing in use.

The seal device may comprise one or more and preferably at least two seals, such as inner seal(s), which may be arranged to face toward and/or seal against the pipeline or other elongate structure in use.

At least one or more or each of the seals, e.g. the inner and/or outer seals may be annular and/or cylindrical. At least one and preferably each of the seals, e.g. the outer and/or inner seals, may comprise an expandable or swellable seal. The swellable seal may be selectively or preferentially swellable in selected fluids, which may comprise fluids found downhole, such as oil and/or water. The outer seal may be swellable or expandable to seal against the bore wall, casing or conduit when swollen or expanded. At least one of the seals, e.g. inner seal(s), may be swellable or expandable to seal against the pipeline or other structure when swollen or expanded.

By providing both inner and outer swellable seals, the seal device may be easily placed in a position on the pipeline whilst at the same time may provide a satisfactory seal against both the pipeline or other structure upon which the seal device is mounted and the inner diameter of the bore wall or casing or conduit in which the seal device is placed.

By providing swellable seals that are selectively or preferentially swellable in fluids found downhole, the likelihood of unwanted swelling of the seals is reduced. If permanent seals such as Viton 'o'-rings are provided, the seals are formed at the surface when the device is exposed to air, thereby risking air being trapped between the seals. In contrast, by providing swellable seals, the seals may only be activated when the seals are in situ and exposed to downhole fluids. In this way, the chances of air or other gasses being trapped between the seals is reduced. This in turn may reduce the risk of the seals being bypassed due to high pressure differentials between gas pockets trapped between seals and the downhole environment in use.

Although at least one or each of the seals, e.g. the outer and/or inner seals, may advantageously comprise a swellable seal, it will be appreciated that, in some applications, a non-swellable seal may be used for at least one or each of the inner and/or outer seals, for example, advantageously as the inner seal. The seals, e.g. the inner and/or outer seal, may comprise a U-seal. The seals, e.g. the inner and/or outer seal, may comprise a unidirectional seal. This may be beneficial, for example, when the well fluid is unknown.

The end members may be in the form of or comprise end rings. The end members may comprise cylindrical or annular members. The end members may comprise inner and outer surfaces, the inner surface at least partially defining a passage having openings at opposing ends of the end member.

The support member may comprise a core and/or sleeve. The support member may comprise a cylindrical or annular support member. The support member may comprise inner and outer surfaces. The inner surface may at least partially define a passage having openings at opposing ends of the support member.

The passages in the support member and/or end member (s) may be in communication and may at least partially define a through passage of the seal device for receiving the pipeline or other elongate structure, i.e. such that the seal device may be mountable on the pipeline or other elongate structure. In other words, the seal device may be provided in the form of a sleeve that can be fitted onto the pipeline or elongate structure at an operator desired location.

The support member and/or the end member(s) may comprise or be formed from a metallic material such as steel.

The support member may be provided between the end members. One or more of the seals, e.g. the inner seals, may be provided on an inner surface of at least one and preferably each end member.

The end members may extend radially outwardly of the support member, e.g. an outer diameter of the end members may be greater than that of the support member. The end members may form protruding shoulders adjacent the support member. At least part of the outer seal(s) may be provided between the end members. The shoulder may protrude by between 0.5 cm and 10 cm, preferably between 1 cm and 5 cms and most preferably between 2 and 3 cms outwardly of the support member. The outside diameter of the end rings may be between 10% and 50% and preferably between 20 and 30% larger than that of the support member.

In this way, in use, at least part of the outer seal(s) may butt against one or each end member such that the end members may act to inhibit extrusion or unwanted movement of the outer seal(s) due to pressure differential across the seal in the well.

The end member(s) may comprise at least one fixer for fixing the end members to the pipeline or elongate structure upon which the seal device is mountable. For example, the or each end member may comprise at least one first fixer and at least one second fixer, wherein the second fixers may be of a different type to the first fixers.

At least one of the fixers may comprise or be configured to receive at least one threaded member such as a set screw or grub screw, which may be configured to secure the end member on the pipeline or other elongate structure. For example, a plurality of threaded members, e.g. grub screws, may be provided or providable in threaded holes in one or more or each end member, such that the threaded members can be tightened to bear against the pipe or other elongate structure upon which the seal device is mounted, thereby fixing the end members in place. The threaded members may be distributed circumferentially around the end member.

At least one of the fixers may comprise a collet. For example, the end member may comprise a collet member, which may be or comprise a collet ring or annular collet member, that comprises the collet. The collet member may define a bore or passage for receiving the pipeline or other elongate member.

The collet may comprise one or more, e.g. a plurality of, collet fingers. The collet member may comprise a collet member body. The collet fingers may extend from the collet member body. The collet fingers may extend in parallel with the bore or through passage. The collet fingers may be connected to the collet member body via a bendable or flexible connection. The bendable or flexible connection may comprise a weakened, cut-out and/or a reduced width portion of the collet finger. At least part of at least one or each of the collet fingers may abut at least one or two adjacent collet fingers. The collet fingers may be bendable or movable radially inwardly, e.g. at the bendable connection. The collet fingers may be distributed circumferentially around the collet member.

The end member may comprise a cooperating member. The cooperating member may be configured to selectively engage the collet fingers so as to move the collet fingers radially inwardly and/or into a gripping configuration.

One or more or each collet finger may comprise a first surface or protrusion, which may be provided on an end of the one or more or each collet finger that is distal from the collet member body and/or bendable or flexible connection. The first surface or protrusion may be shaped so as to engage with a corresponding surface on the cooperating member to bend or move the collet finger, e.g. radially inwardly or into the bore or through passage and/or into a gripping configuration. The gripping configuration may be a configuration in which the collet finger grips the pipeline or other elongate structure, in use.

The first surface or protrusion may slope radially outwardly, e.g. in a direction from the distal end of the collet finger toward the collet member body and/or bendable or flexible connection.

The collet member may comprise or define a locating profile, such as a recess or protrusion, and/or a shoulder, which may be or comprise an annular or circumferential locating profile or shoulder. The shoulder may be configured to abut or engage with an end of the cooperating member in at least one relative position of the collet member and the cooperating member. The locating profile may be configured to engage or interlock with a corresponding locator profile on the cooperating member in the at least one relative position of the collet member and the cooperating member. In this way, the collet member and the cooperating member may be held together in the at least one relative position, which may be a relative position corresponding with the gripping configuration of the collet fingers.

The threaded members, e.g. the set screws and/or grub screws, may be provided or providable in the end member body.

The cooperating member may be or comprise an annular or cylindrical body. The cooperating member may define a through bore or passage, which may be defined by a bore or passage wall. At least part of the collet end member, which may comprise at least the collet fingers and optionally at least a part of the collet member body, may be received or receivable in the bore or passage of the cooperating member. The pipeline or other elongate structure may be receivable in the bore or passage of the cooperating member.

The at least part of the collet member may be receivable through a first end of the bore or passage of the cooperating member. A second end of the bore or passage, which may be opposite the first end, may have a smaller diameter than the first end of the bore or passage.

The bore or passage wall of the cooperating member may define the corresponding surface, which may engage with the first surface of the collet fingers. The corresponding surface may be or comprise a sloping surface. The bore or passage of the cooperating member may decrease in diameter from a side of the corresponding surface that is toward the first end of the bore or passage (e.g. the end into which the collet member is inserted) to a side of the corresponding surface that is toward the second end of the bore or passage. The corresponding surface may extend circumferentially around the bore or passage of the cooperating member.

In this way, when the collet fingers are inserted into the bore or passage of the cooperating member, the collet fingers (specifically the first surface of the collet fingers) may engage the corresponding surface of the cooperating member. The corresponding surface of the cooperating member and the first surface of the collet fingers may be shaped so that the corresponding surface pushes the collet fingers inwardly, e.g. towards a central axis of the bore or passage. In this way, insertion of the collet member into the bore or passage (or moving the cooperating member onto the collet fingers) may act to push the collet fingers into gripping engagement with the pipeline or other elongate structure located in the bore or passage. The provision of a collet beneficially may add an additional fixing mechanism and beneficially may prevent extrusion of seals past the end member, through the bore or passage.

At least one of the seals, e.g. the inner seal, may be or comprise an annular seal and/or may comprise a Viton or other elastomeric seal.

A positioning protrusion may extend into the bore or passage of the cooperating member. The positioning protrusion may extend circumferentially around the bore or passage of the cooperating member. The positioning protrusion may be provided towards the second end of the bore or passage of the cooperating member. The positioning protrusion may be configured to engage with an end of a seal, such as the inner seal.

An end of the support member (e.g. the core or sleeve) may be receivable through the second end of the bore or passage of the cooperating member. The end of the support member may abut a side of the positioning protrusion that is opposite a side of the positioning protrusion that engages the seal, e.g. the inner seal. In other words, the seal, e.g. the inner seal may abut against a side of the positioning protrusion that is towards the first end of the bore or passage and the support member may abut a side of the positioning protrusion that is towards the second end of the bore or passage. The support member may optionally be fixed or fixable to the cooperating member.

The distal ends of the collet fingers may be located or locatable adjacent, proximate or abutting the seal, e.g. the inner seal, e.g. in the at least one relative position of the collet member and the cooperating member.

The seal device, e.g. the or each end member, may comprise at least one, e.g. a plurality of, support elements. Each support element may be annular and or be or comprise a ring. The support member may be received or receivable through the annulus of the at least one or each support element, e.g. the support elements may be mounted or mountable on the support member.

The support elements may comprise opposed first and second faces. The first face of at least one of the support elements may abut and/or be bonded or fixed or fixable to an end of the cooperating member. The first face of the at least one support element may comprise a planar surface.

The first face of at least one of the support elements and/or a first face of the outer seal may comprise a protruding portion, such as an annular or circumferential protruding portion, that may extend around the first face.

The second face of at least one of the support elements may define a groove or recess, such as an annular or circumferential groove or recess, which may extend around the second face. The protruding portion of the first face of another of the support elements and/or of the outer seal may be located or receivable in the groove or recess of the at least one of the support elements.

The groove or recess may have a concave or generally C-shaped cross section. The groove or recess may be at least partially defined between a first extending part of the support element and/or a second extending part of the support element. The first extending part may be provided radially outwardly of the second extending part. The first and second extending parts may extend generally in parallel with a longitudinal, central or symmetry axis of the pipe, support element and/or bore or passage. At least one or each support element may be asymmetric, e.g. may comprise an asymmetric cross section, such as in the radial direction. The first (e.g. outer) extending part may be longer (e.g. in cross section) than the second (e.g. inner) extending part. The at least one support element may be formed from a deformable material, e.g. an elastomeric material.

In this way, when the outer seal swells or expands, the protruding section of the outer seal within the groove or recess of the support element may expand or swell, which may thereby force the first (e.g. outer) and second (e.g. inner) extending parts apart. In other words, swelling of the protruding portion of the outer seal may force the first extending part radially outwardly and/or force the second extending part radially inwardly. This may force the support element against a bore wall, conduit, liner or other structure in which the seal device is located and/or may force the support element against the support member.

In this way, the support element(s) may provide additional sealing of the wellbore, conduit, liner or other structure in which the seal device is located. In addition, the support element(s) may prevent extrusion of the outer seal past the support elements, thereby improving the sealing provided by the outer seal.

When a plurality of support elements are provided, the protruding portion of one of the support elements may be provided in the recess or groove of an other of the support elements. When the first and second extending parts of the support element are forced apart, the protruding portion of the support element also increases in size, which may thereby also force the first and second extending parts of the other support element apart. In this way, a plurality of support elements may be operable by swelling of the outer seal, which may provide additional or back-up sealing and further prevent extrusion of the outer seal.

Optionally, at least one of the fixers may comprise a lock device such as a lock ring. The lock device may comprise a gripping member, which may comprise a band, ring or a portion of a ring, such as a split ring. The gripping member may be elastomeric. The gripping member may be provided on an inner surface of the seal device, e.g. facing inwardly towards the passageway of the seal device so as to face the pipeline or other structure upon which the seal device is mountable. The gripping member may comprise a roughened surface, protrusions or other patterning, which may act to improve the grip on the pipeline. The lock device may comprise one or more operating devices such as screws, ratchets, or the like, that may be operable to act on the gripping member to selectively increase and/or decrease the grip of the gripping member on the pipeline or other structure, e.g. by selectively tightening/tensioning and/or loosening the gripping member. The operating device may be operable to selectively open and close the split ring, thereby adjusting the grip of the lock device. Preferably, the operating devices are operable from outside of the seal device.

The lock ring may apply grip over a whole surface area of the gripping member, which results in a larger gripping surface relative to a plurality of grub screws, which instead provide a series of discrete gripping points. Therefore, use of a lock ring may more securely secure the seal device in place on the pipeline or other structure.

Furthermore, a lock device, such as a lock ring, may require less operating devices such as set screws to achieve an acceptable grip on the pipeline or other structure, which may result in quicker and/or easier installation of the seal device.

At least one fixer (such as the lock ring or collet member) may be provided adjacent, in contact with or proximate a seal, e.g. an inner seal, on at least one and preferably each end member. One or more fixer may be provided on an endward or distal side of the seal, e.g. the inner seal, which may be a side of the seal opposite the support member and/or one or more fixer may be provided on an opposite or inner side of the seal. Each end member may comprise a fixer and the seal, e.g. the inner seal(s), may be provided between the fixers of opposing end members.

By providing one or more fixers such as the lock rings or collet members adjacent to one or more or each seal, e.g. inner seal, the fixers may provide additional support to the seal, e.g. the inner seal, such that extrusion or unwanted movement of the seals, e.g. the inner seals, under action of pressure differential in the bore may be minimised. In addition, since such fixers contribute both to fixing the seal device in place on the pipeline and inhibiting extrusion of the seals, e.g. the inner seals, the number of parts required to perform these functions may be reduced.

The seal device may comprise an eccentric seal device. In other words, the geometric centre of a transverse cross section of the seal device (and preferably the end ring(s) and/or outer seal member) is displaced relative to the geometric centre of the through passage (and preferably also the support member) in transverse cross section. The thickness of walls and/or the outer seal of the seal device may vary around its circumference, for example, such that the thickness of the walls and/or the outer seal of the seal device at one portion of its circumference is greater than that at another portion. Preferably the thickness of the walls and/or the outer seal of the seal device may continuously vary around its circumference.

In this way, the seal device may be suitably oriented on a pipeline or other structure but at the same time align with other components in the bore, which may be eccentric or unsymmetrical.

The seal device may comprise a longitudinally extending line passage, which may be configured to receive at least one line, such as an electrical, hydraulic, fibre optic and/or pneumatic line. The at least one line may comprise a control line.

The line passage may comprise a slit and/or conduit. The line passage may be provided in the outer seal and/or the end members. At least parts of the line passage may be open to an outer surface of the seal device, for example, via a slit or the like. The end members may be provided with at least one fixer or securing member, which may act to clamp or grip the line. The at least one fixer or securing member may be selectively fixable and/or removable, which may comprise use of fixing means such as bolts.

The above arrangement may provide a simple and/or quick method for securing the line.

The line passage may be provided at a thicker portion of the circumference of the seal device, such as the thickest portion, e.g. in an eccentric seal device.

According to a second aspect of the invention is an end member for a seal device, such as a downhole packer.

The seal device may comprise a seal device of the first aspect.

The end members may comprise or be formed as an end ring. The end members may comprise a cylindrical or annular member that defines a passageway or annulus therethrough, e.g. for receiving a pipeline or other elongate structure. The seal device may be mounted or mountable on the pipeline or other elongate structure.

The end member(s) may comprise an eccentric end member. The thickness of the walls of the end member may vary around its circumference, for example, such that the thickness of the walls of the end member at one portion of its circumference is greater than that at another portion. Preferably the thickness of the walls of the end member may continuously vary around its circumference.

The end member may be formed from a metallic material such as steel.

The end member may comprise at least one seal, e.g. inner seal. The seal, e.g. the inner seal, may comprise an annular seal. The seal, e.g. the inner seal, may be provided facing into the annulus or passageway of the end member. The seal, e.g. the inner seal, may comprise a swellable seal, which may be selectively or preferentially swellable in a desired fluid, which may comprise fluid found in the well bore or in use, such as oil or water. However, it will be appreciated that, for some applications, the seal, e.g. the inner seal, may comprise a non-swellable seal. For example, the seal, e.g. the inner seal, may comprise a Viton or other elastomeric seal. The inner seal may comprise a U-seal. The seal, e.g. the inner seal, may comprise a unidirectional seal.

The end member may be provided with at least one fixer. For example, the or each end member may comprise at least one first fixer and at least one second fixer, wherein the second fixers may be of a different type to the first fixers.

At least one of the fixers may comprise a collet. The end member may comprise a collet member and a cooperating member. The at least one inner seal may be provided between at least part of the collet member and at least part of the cooperating member. The collet member, cooperating member and/or the end inner seal may be annular.

The collet member may comprise at least one or a plurality of collet fingers. The cooperating member may define an annulus, bore or passage. The collet fingers may be located or locatable in the annulus, bore or passage of the cooperating member. The collet fingers may comprise a first outer surface, which may be configured to cooperate with a corresponding surface of a wall of the annulus, bore or passage of the cooperating member in order to force the collet fingers radially inwardly and/or into a gripping configuration. The first outer surface may be provided at a distal end of the collet fingers. The first outer surface may slope radially outwardly, e.g. in a direction from the distal end of the collet fingers towards a collet end member body.

The collet member may be operable to grip the pipeline or other elongate member, e.g. in the gripping configuration of the collet fingers.

The collet member and/or cooperating member may comprise at least one feature of the collet member and/or cooperating member and/or that at least one support element and/or inner seal described above in relation to the first aspect, but which are not repeated purely for the sake of conciseness.

At least one of the fixers may comprise a lock device such as a lock ring. The lock device may comprise a gripping member, which may be elastomeric. The gripping member may be in the form of a ring or a portion of a ring. The gripping member may be provided on an inner surface of the seal device, e.g. facing inwardly towards the passageway or annulus of the seal device. In this way, the gripping member may face the pipeline or other structure upon which the seal device is mountable in use. The lock device may comprise one or more operating devices such as screws, ratchets, or the like, that are operable to act on the gripping member to selectively increase and/or decrease the grip of the gripping member on the pipeline or other structure.

At least one of the fixers may comprise one or more threaded fixing members such as grub or set screws.

At least one or more of the fixers may be provided adjacent, proximate or abutting the inner seal.

According to a third aspect of the invention is a chassis for a seal device according to the first aspect, the chassis comprising a support member and first and second end members fixed to opposing ends of the support member.

According to a fourth aspect of the present invention is a method for producing a seal device according to the first aspect.

The method may comprise welding the support member to the at least one and preferably two end members. The weld may comprise a full circle weld.

The method may comprise integrally forming the support member and at least one and preferably two end members.

The method may comprise providing at least one inner seal facing an inner surface, passageway or annulus through the seal member.

The method may comprise providing at least one outer seal on an outer surface of the seal member.

The inner and/or outer seal member(s) may comprise swellable seal members. The inner and/or outer seal member (s) may comprise non-swellable members. The inner and/or outer seal member(s) may comprise a U-seal. The inner and/or outer seal may comprise a unidirectional seal.

According to a fifth aspect of the present invention is a method for fixing a seal device according to the first aspect to a pipeline or other structure.

The method may comprise mounting the seal device to the pipeline or other structure, such that at least a portion of the pipeline or other structure is received within the passageway or annulus of the seal device. The method may comprise providing fluid to the inner and/or outer seal(s) so as to swell the inner and/or outer seals. The inner seals may be swollen to seal against the pipeline or other structure. The outer seals may be swollen to seal against a bore wall or casing.

The method may comprise using the operating device(s) of the seal device in order to tighten or tension the gripping member of the lock device around or to the pipeline or other structure.

According to a sixth aspect of the present invention is a method for inserting a line though a seal device according to the first aspect.

The method may comprise providing a line, such as a control line, through a line passage in the seal device. The method may comprise securing the line using securing members of the end member(s).

It will be appreciated that features analogous to those described above in relation to any of the above aspects may be individually and separably or in combination applicable to any of the other aspects.

Apparatus features analogous to those described above in relation to a method and method features analogous to the use and construction of those described above in relation to an apparatus are also intended to fall within the scope of the present invention.

BRIEF DESCRIPTION OF THE DRAWINGS

Embodiments are now described, by way of non-limiting example, and are illustrated in the following figures, in which.

DETAILED DESCRIPTION OF THE DRAWINGS

Figure 1:
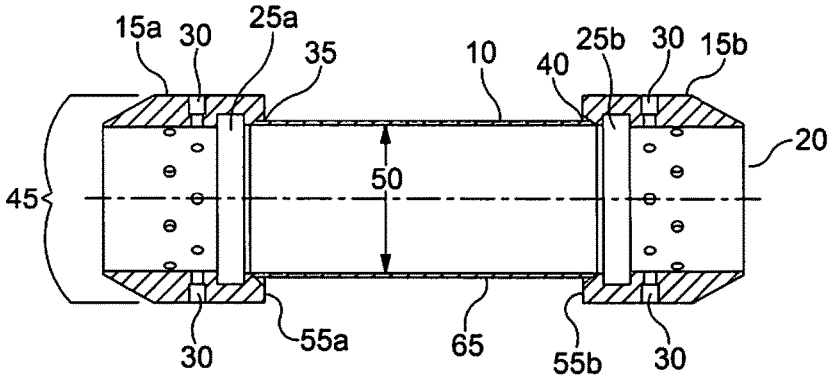
FIG. 1 shows a cross sectional view of part of a seal device according to an embodiment of the present invention.
Figure 2:
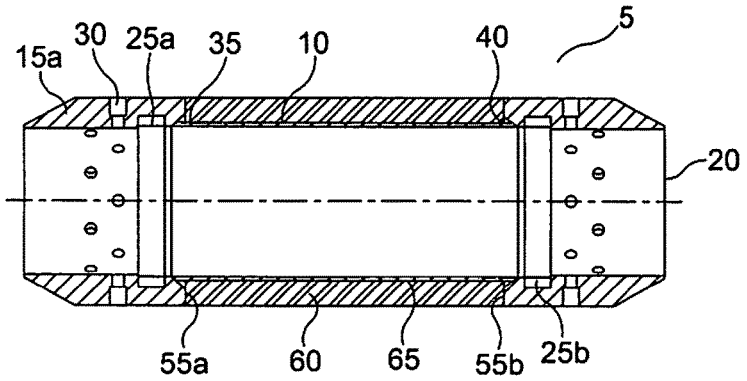
FIG. 2 shows cross section view of a seal device, part of which is shown in FIG. 1.

FIG. 1 shows a cross section through a chassis of a seal device in the form of a downhole packer 5 (shown in FIG. 2) for mounting to a pipeline or other elongate structure. The packer 5 is operable to provide a seal between the pipeline or structure and a hole or bore wall (or bore casing if the bore is cased) or conduit in which the packer 5 is located. FIG. 2 shows a cross section through the whole packer 5.

The packer 5 comprises a support member in the form of a cylindrical core 10 disposed longitudinally between a pair of fixing members in the form of cylindrical end rings 15*a*, 15*b*. Each of the end rings 15*a*, 15*b* and the core 10 are annular and define a longitudinally extending passage 20 therethrough to receive the pipeline. In this way, the packer 5 takes the form of a sleeve that can be fitted onto the pipeline.

Each of the end rings 15*a*, 15*b* is provided with an annular inner seal member 25*a*, 25*b* that faces the passage 20. Each of the end rings 15*a*, 15*b* is also provided with a plurality of fixers in the form of set screws 30 for fixing the end rings 15*a*, 15*b* and thereby the packer 5 to the pipeline. For example, the set screws 30 could be tightened in threaded apertures in order to bear against and thereby grip the pipeline or other structure upon which the packer 5 is mounted.

The cylindrical core comprises an outer surface 65 that faces the bore wall or casing or conduit in use and an inner surface that faces the pipeline in use. The cylindrical core 10 is welded at longitudinal ends 35, 40 to the respective end rings 15*a*, 15*b* using a full circle weld. The end rings 15*a*, 15*b* each have an outer diameter 45 that is larger than the outer diameter 50 of the cylindrical core 10 so as to form shoulders 55*a*, 55*b* that protrude radially outwardly at each end of the cylindrical core 10.

As can be seen from FIG. 2, a cylindrical outer seal member 60 is provided on the outer surface 65 of the cylindrical core 10, between the shoulders 55*a*, 55*b* formed by the respective end rings 15*a*, 15*b*. The outer seal member 60 is bonded to both the core 10 and the end rings 15*a*, 15*b*.

Since the cylindrical core 10 is welded to the end rings 15*a*, 15*b* and the outer seal member 60 is bonded to the core 10 and end rings 15*a*, 15*b*, the packer 5 is provided in the form of a one-piece or unitary structure. This results in a stronger and more robust packer 5 that is easily fitted and reduces the risk of failure, for example, when being run through tortuous well paths or under extreme operating conditions.

Advantageously, both the inner seal members 25*a*, 25*b* and the outer seal member 60 are formed using swellable material. The swellable material can comprise swellable rubber or other suitable swellable material known in the art. In particular, the swellable material is selectively swellable in specific fluids such as oil or water. In this way, swelling of the inner and outer seals can be inhibited until a required time, whereupon the seals can be selectively exposed to the appropriate swelling fluid. For example, the swelling fluid may be a fluid found downhole when the packer 5 is in use. In this way, the packer 5 may be easily mounted on the pipeline and the chance of forming a hydrostatic chamber between the two inner seals 25*a*, 25*b* due to premature swelling may be minimised, as the seals 25*a*, 25*b* do not form seals against the pipeline when the production pipeline is being assembled and will instead only swell to provide the seal when exposed to fluid in the bore or conduit, i.e. when in-situ.

Furthermore, since swellable inner 25*a*, 25*b* and outer 60 seal members are provided, the packer 5 can effectively seal against both the pipeline upon which it is mounted and the conduit, bore walls or casing within which the packer is provided.

Since the outer diameter 45 of the end rings 15*a*, 15*b* is greater than the outer diameter 50 of the cylindrical core 10, the shoulders 55*a*, 55*b* formed by the end rings 15*a*, 15*b* act to inhibit extrusion or movement of the swollen outer seal under operational pressure differentials across the seal, particularly when working at depth.

In an initial (unswollen) configuration, embodiments of the packer can have an outer diameter of between 5 and 100 cms, and preferably between 10 and 30 cms, depending on the application. In this particular example, the packer in the initial (unswollen) configuration is approximately 20 cm in outside diameter. The packer can vary in length depending on the degree of sealing required. However, in embodiments, the packer may be between 10 and 150 cms long and preferably between 40 and 80 cms long. In this particular example, the packer is approximately 61 cms long. The passage or annulus in the initial (unswollen) configuration is sufficiently large to provide a gap between the packer and the pipeline or other structure to which it is to be mounted in order to allow the packer to be easily fitted over the pipeline or other structure, but not so large that the gap cannot be closed by the swelling of the inner seals. For example, the passage may have a diameter of between 5 cms and 100 cms and preferably between 10 and 20 cms. In this specific example, the diameter of the passage is approximately 14.5 cms.

Figure 3:
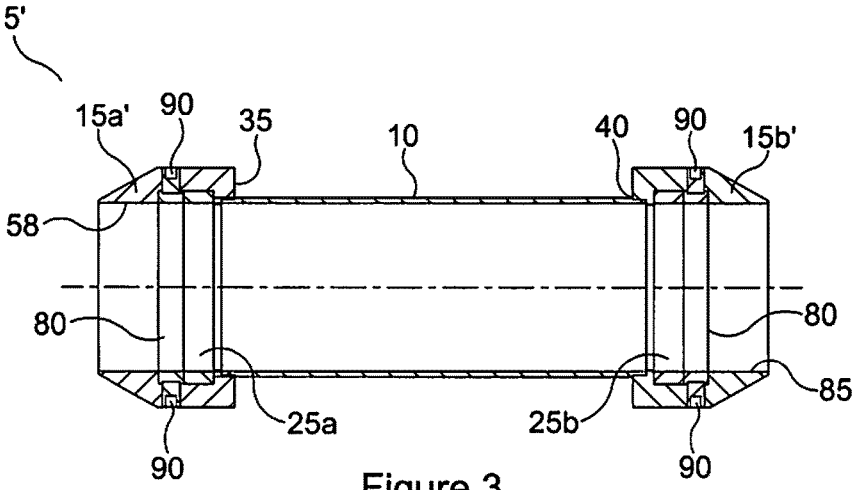
FIG. 3 shows a cross sectional view of a part of a seal device according to another embodiment of the present invention.
Figure 4:
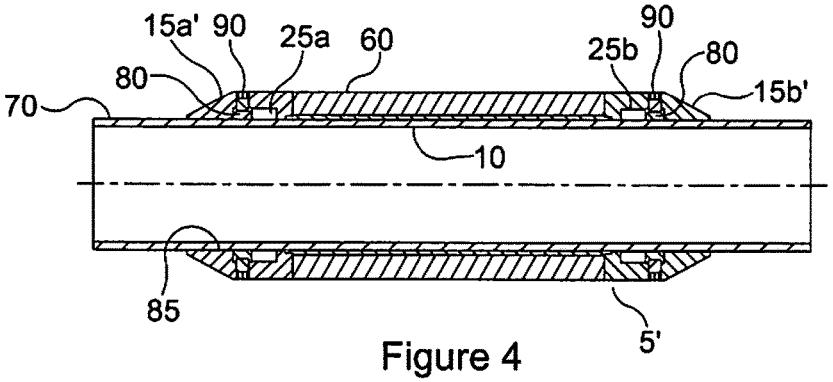
FIG. 4 shows a cross sectional view of a seal device, part of which is shown in FIG. 3, in situ on a pipeline.
Figure 5:
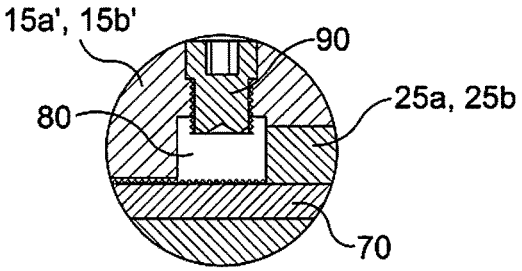
FIG. 5 shows a cross sectional view of a detail of the seal device shown in FIG. 4.
Figure 6:
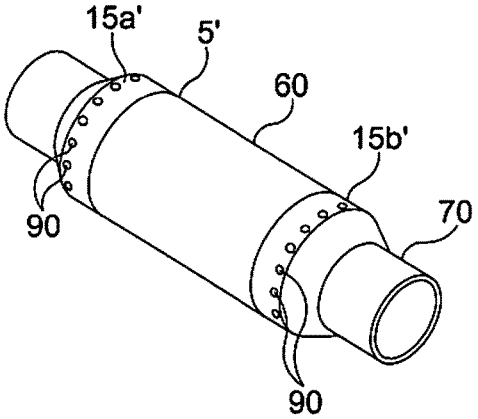
FIG. 6 shows a perspective view of the seal device of FIG. 4 in situ on a pipeline.
Figure 7:
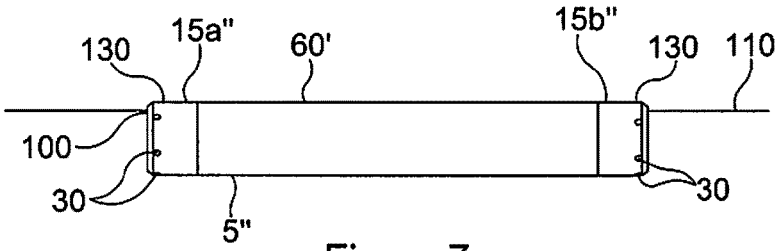
FIG. 7 shows a side view of a seal device according to an embodiment of the present invention and a control line.
Figure 8:
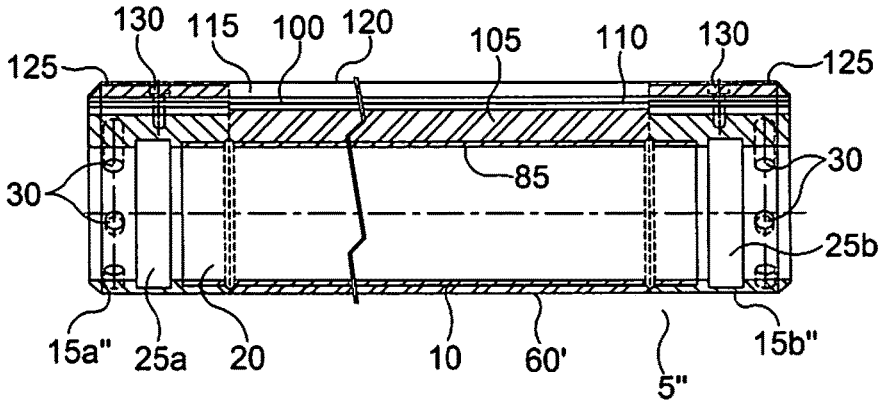
FIG. 8 shows a longitudinal cross section of the seal device of FIG. 7.
Figure 9:
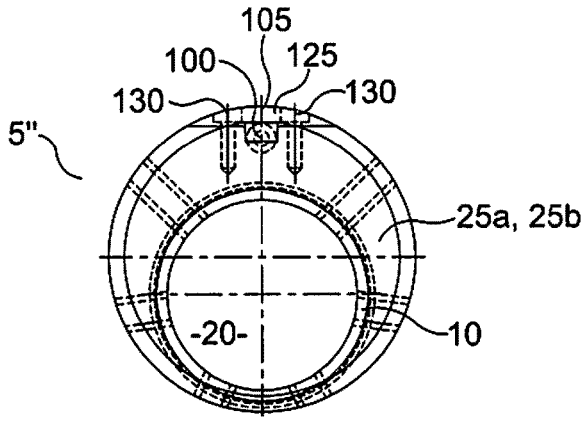
FIG. 9 shows a transverse cross section through the seal device of FIG. 7.
Figure 10:
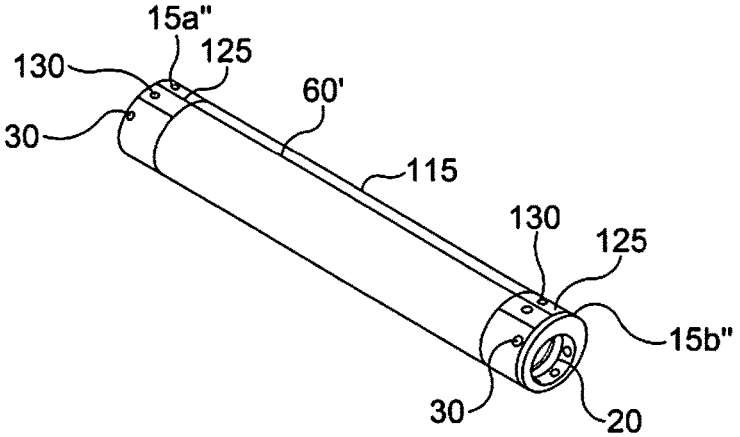
FIG. 10 shows a perspective view of the seal device of FIG. 7.

Another embodiment of the present invention is illustrated with reference to FIGS. 3 to 6. FIG. 3 shows a cross section of a chassis of a seal device in the form of a packer 5', whilst the whole packer 5' is shown in situ mounted on a pipeline 70 in FIG. 4. The packer 5' of FIGS. 3 to 6 is similar to the packer 5 shown in FIGS. 1 and 2 and the same reference numerals are used to indicate like components. However, the packer 5' of FIGS. 3 to 6 comprises different fixers to the packer 5 of FIGS. 1 and 2. In particular, rather than using a plurality of set screws 30, as in the packer of FIGS. 1 and 2, each end ring 15*a*', 15*b*' in the packer 5' of FIGS. 3 to 6 comprises a fixer in the form of a lock ring 80

Each lock ring 80 comprises an annular metal toothed band that is provided on an inner surface 85 of the respective end ring 15*a*', 15*b*' that forms the passage 20 that receives the pipeline 70. A plurality of locking screws 90 are provided which are operable to exert a force on the metal toothed band so as to force the band into gripping engagement with the pipeline 70, as shown in detail in FIG. 5. In an optional embodiment, the metal toothed band 80 is provided in the form of a split ring.

By providing a lock ring 80 rather than a plurality of set screws 30, fewer screws may be required to achieve a satisfactory grip on the pipeline and the packer 5' can be fixed in position on the pipeline much faster. Furthermore, since the lock ring 80 grips over the whole surface of the band, a much higher force may be required to move the end ring 5' having the lock ring 80 relative to the embodiment that uses only set screws 30, which instead grip at a plurality of discrete locations.

Advantageously, the lock ring 80 on each end ring 15*a*', 15*b*' is provided directly adjacent to the respective inner seal 25*a*, 25*b*. In this embodiment, the lock ring 80 is provided on a longitudinally endward side of the inner seal 25*a*, 25*b*, i.e. on a side away from the cylindrical core 10. However, it will be appreciated that in other embodiments a lock ring could alternatively or additionally be provided on an opposite side of the inner seal 25*a*, 25*b*, i.e. toward the centre of the seal device.

In this way, since the lock ring 80 is directly adjacent to the inner seal 25*a*, 25*b*, when the inner seal 25*a*, 25*b* is swollen, it can butt against the lock ring 80 such that the lock ring 80 provides additional support to the inner seal 25*a*, 25*b* and reduces or substantially closes the gap between the pipeline 70 and the end ring 15*a*', 15*b*' on the endward side of each inner seal 25*a*, 25*b*. In this way, extrusion or movement of the inner seals 25*a*, 25*b* under operational pressure differentials or fluid flow is inhibited.

As such, in this embodiment, the lock ring 25*a*, 25*b* serves a dual purpose of securing the packer 5' on the pipeline 70 and minimising extrusion of the inner seal 25*a*, 25*b*.

Another seal member in the form of a packer 5" is shown in FIGS. 7 to 10. The packer 5" of this embodiment is similar to the embodiment shown in FIGS. 1 and 2 and like components are numbered similarly. However, whereas the packer shown in the embodiment of FIGS. 1 and 2 is concentric, the packer 5" of FIGS. 7 to 10 is eccentric. In particular, although the passage 20 through the packer 5" remains circular, the geometric centres of the end rings 15*a*", 15*b*" and the outer seal 60' (and thereby the packer 5" as a whole) in transverse cross section are displaced relative to the geometric centre of the passage 20 and the cylindrical core 10 in transverse cross section. The effect of this is that the thickness of the walls of the end rings 15*a*", 15*b*" and the outer seal 60' continuously vary circumferentially, with a thinnest part of the end ring 15*a*", 15*b*" and outer seal 60' being opposite the thickest part.

Furthermore, in the embodiment shown in FIGS. 7 to 10, a channel 100 is formed through the thickest part 105 of the end rings 15*a*", 15*b*" and the outer seal 60'. The channel 100 is configured to hold a line 110 such as a control line 110 (which may be, for example, an electric, fibre optic or pneumatic control line). A slit 115 extends between the channel 100 and the outer diameter 120 of the outer seal 60' to allow insertion of the control line 110 into the channel 100. The end rings 15*a*", 15*b*" each comprise a removable cap 125 attached by fixing bolts 130, which forms part of the channel 100 that passes through the end caps 15*a*", 15*b*". In this way, the removable cap 125 can be selectively removed by unfastening the fixing bolts 130 to allow the control line 110 to be inserted or removed, and then bolted back into place such that the cap 125 securely clamps the control line 110 in place.

This allows the control line 110 to be simply inserted and securely held in place in order to enable the function of tools to operate beyond the isolation point formed by the packer 5".

By providing an eccentric packer 5", the packer 5" can align with other eccentric completion components yet still seal off and create a positive seal against the inner diameter of an open or cased hole and the outer diameter of the pipeline to which the packer 5" is mounted.

While various features have been described above in relation to three examples of a packer 5, 5', 5", it will be appreciated that features described in relation to one example could equally be provided in combination with one or more features described in relation to any of the other examples.

While certain embodiments have been described, these embodiments have been presented by way of example only, and are not intended to limit the scope of the invention. Indeed the novel methods and systems described herein may be embodied in a variety of other forms. Furthermore, various omissions, substitutions and changes in the form of the methods and systems described herein may be made without departing from the invention. The accompanying claims and their equivalents are intended to cover such forms and modifications as would fall within the scope of the invention.

For example, whilst embodiments have been described above in which the core 10 is welded to the end rings 15*a*, 15*b*, it will be appreciated that the core 10 may be integral with the end rings 15*a*, 15*b* or other suitable fixing or bonding mechanisms could be used.

Furthermore, whilst various of the examples of packer given above are secured to the pipeline by set screws 30 and/or lock rings 80, it will be appreciated that other suitable clamping, gripping or fixing mechanisms could be used.

For example, in an embodiment shown in FIGS. 11 to 30, two different types of fixing mechanism are used to fix the end rings to the pipeline or other elongate structure. In this embodiment, a collet and grub screws are used as the two fixing mechanisms. However, it will be appreciated that other combinations of fixing mechanism could be used.

Figure 11:
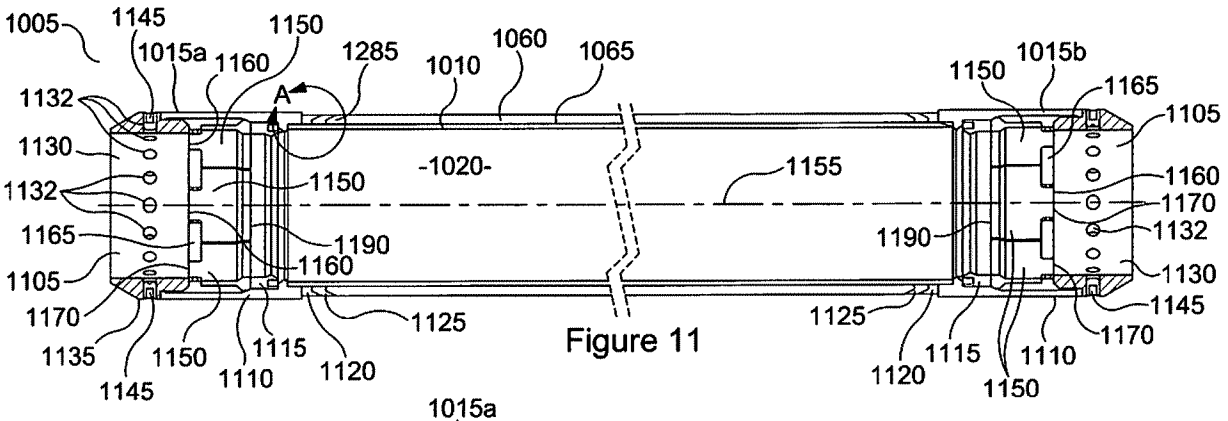
FIG. 11 is a schematic side view of an alternative seal device having alternative end rings.
Figure 12:
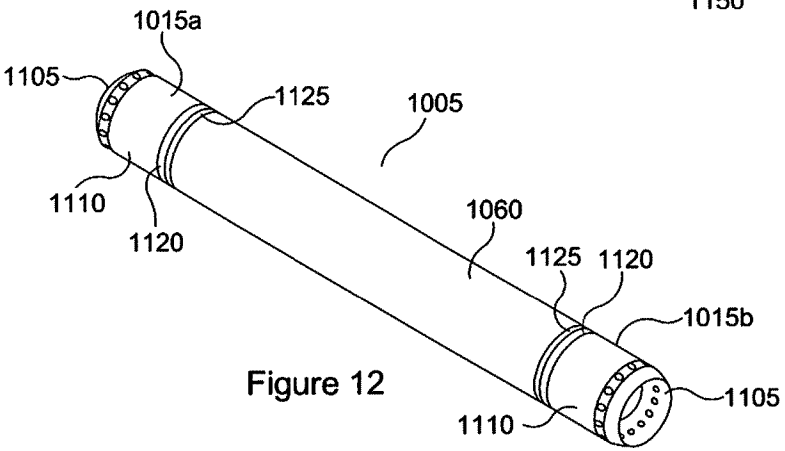
FIG. 12 is a perspective view of the seal device of FIG. 11.
Figure 13:
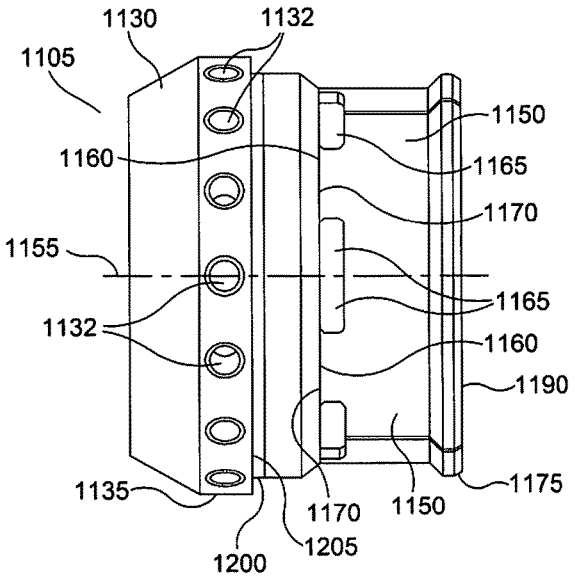
FIG. 13 is a schematic side view of a collet ring of the seal device of FIGS. 11 and 12.
Figure 14:
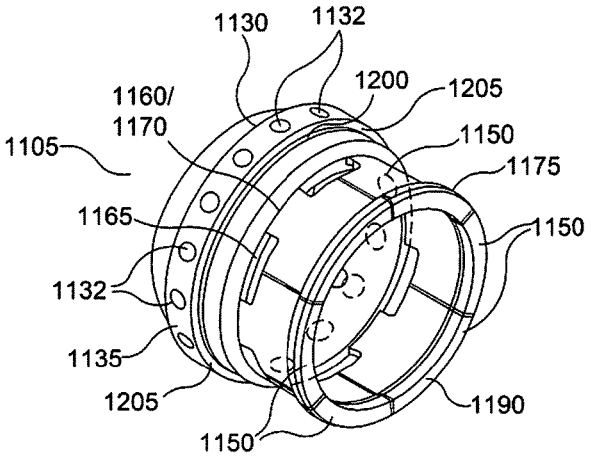
FIG. 14 is a perspective view of the collet ring of FIG. 13.
Figure 15:
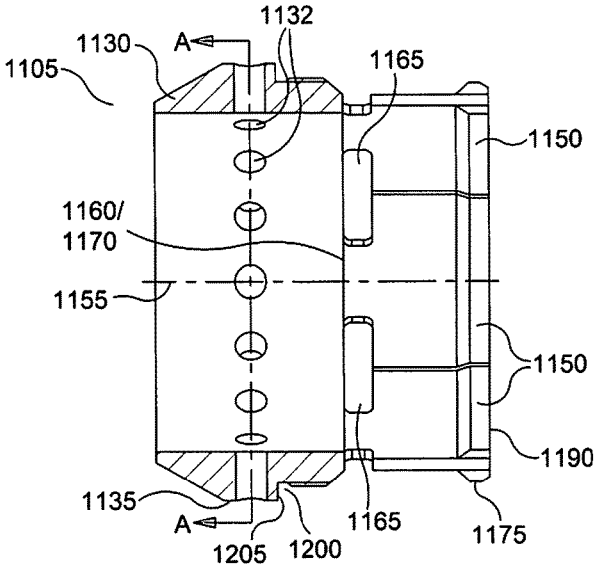
FIG. 15 is a side cross sectional view of the collet ring of FIGS. 13 and 14.
Figure 16:
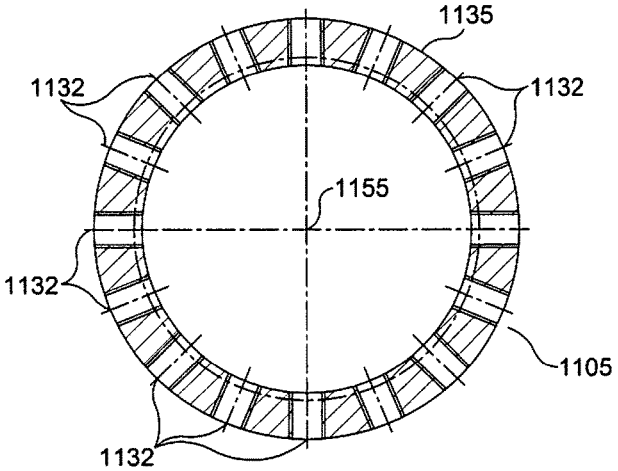
FIG. 16 is a cross sectional view of the collet ring taken through the section A-A in FIG. 15.

FIGS. 11 and 12 show a seal device in the form of a downhole packer 1005 for mounting to a pipeline or other elongate structure (not shown). The packer 1005 is operable to provide a seal between the pipeline or other elongate structure and a hole or bole wall or a casing, liner or conduit (not shown) in which the packer 1005 is located in use. In this example, the packer 1005 is a unitary packer comprising a support member in the form of a cylindrical core 1010 disposed longitudinally between, and fixed to, a pair of cylindrical end rings 1015*a*, 1015*b*. However, it will be appreciated that the end rings 1015*a*, 1015*b* described herein may be used in other packer or seal device systems, which need not be unitary systems and need not be used with or fixed to the core 1010.

As in the packers described above, each of the end rings 1015*a*, 1015*b* and the core 1010 are annular and define a longitudinally extending passage 1020 therethrough to receive the pipeline or other elongate structure. An outer seal member 1060 extends circumferentially around an outer surface 1065 of the core 1010. The outer seal member 1060 is swellable in oil or other fluid.

Each of the end rings 1015*a*, 1015*b* comprises a collet ring 1105, a cooperating ring 1110, an inner seal 1115, a back-up ring 1120 and a support ring 1125, which are each annular and define a passage therethrough. In use, the pipeline or other elongate structure extends through the passage 1020. In other words, each of the collet ring 1105, the cooperating ring 1110, the inner seal 1115, the back-up ring 1120 and the support ring 1125 are effectively mounted around the pipeline or other elongate structure. However, it will be appreciated that at least the collet rings 1105, (and optionally at least part of the inner seals 1115 and/or cooperating rings 1110) are directly mounted or mountable on the pipeline or elongate structure, whilst the back-up ring 1120 and the support ring 1125 are mounted on the core 1010, which is in turn mounted or mountable on the pipeline or elongate structure.

As shown in FIGS. 13 to 16, the collet ring 1105 comprises an annular collet ring body 1130. The collet ring body 1130 comprises a plurality of threaded through holes 1132 extending from an outer surface 1135 of the collet ring body 1130 to an inner surface 1140 that defines the part of the passage 1020. The threaded holes 1132 are distributed circumferentially around the collet ring body 1130 and are configured to receive a grub or set screw 1145 for selectively gripping the pipeline or other elongate structure.

A plurality of collet fingers 1150 extend from an end of the collet ring body 1130 in a direction generally in parallel with a longitudinal axis 1155 of the passage 1020. The collet fingers 1150 are distributed circumferentially around the collet ring body 1130 and together define a part of the passage 1020. Each of the collet fingers 1150 are joined to the collet ring body 1130 by a bendable or flexible hinge 1160, in this case formed by notches 1165 in the collet fingers that provide a reduced width portion 1170 of the respective collet finger 1150.

In order to operate the collet ring 1105, at least the collet fingers 1150 are inserted into a passage 1020*a* through the cooperating ring 1110 that forms part of the passage 1020. Shaped outer surface portions 1175 of the collet fingers 1150 are configured to engage with correspondingly shaped cooperating portions 1180 of a passage wall 1185 of the cooperating ring 1110 when the collet fingers 1150 are inserted into the passage 1020*a* of the operating ring 1110 in order to force the collet fingers 1150 radially inwardly into the passage 1020, 1020*a*, i.e. towards the pipeline or other elongate structure located in the passage 1020, 1020*a* and upon which the packer 1005 is mounted.

In particular, the shaped outer surface portions 1175 are located at a distal end 1190 of the respective collet finger 1150 (i.e. an end furthest from the collet ring body 1130 and/or the bendable or flexible hinge 1160), wherein the shaped outer surface portions 1175 slope radially outwardly from the distal end 1190 of the respective collet finger 1150.

Figure 17:
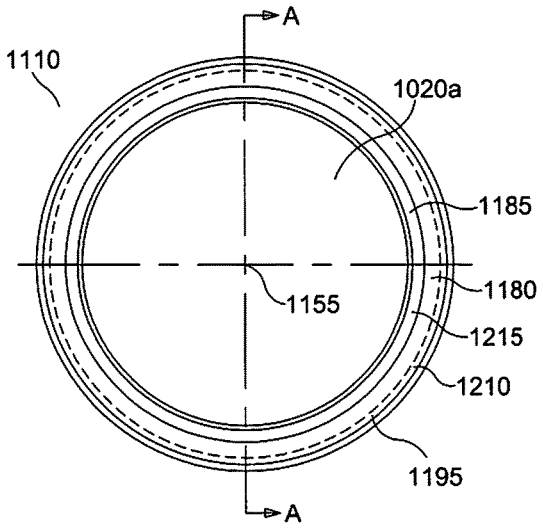
FIG. 17 is an end view of a cooperating ring of the seal device of FIGS. 11 and 12.
Figure 18:
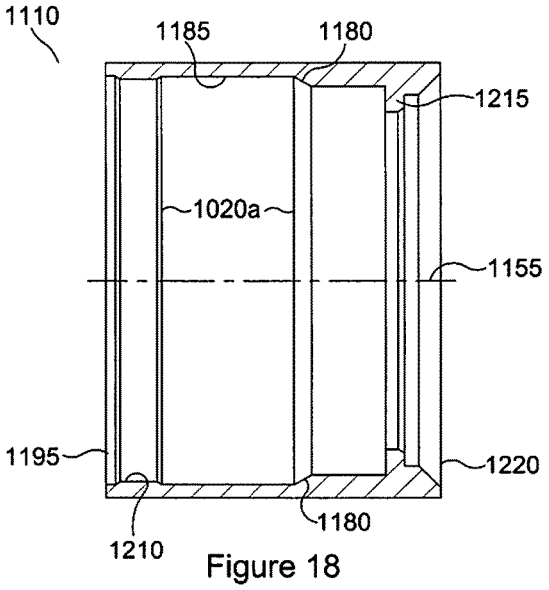
FIG. 18 is a side cross section view of the cooperating ring of FIG. 17 taken through the section A-A in FIG. 17.
Figure 19:
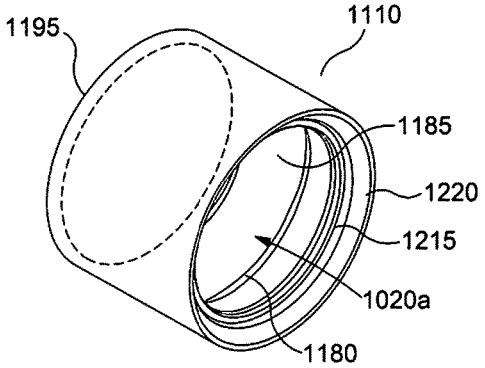
FIG. 19 is a perspective view of the cooperating ring of FIGS. 17 and 18.

As shown in FIGS. 17 to 19, the cooperating portions 1080 of the cooperating ring 1110 protrude from, and extend circumferentially around, the passage wall 1185 of the cooperating ring 1110. The cooperating ring 1110 is configured such that the collet ring 1105 is received into the passage 1020*a* through a first end 1195 of the passage 1020*a*. The cooperating portion 1180 of the cooperating ring 1110 slopes such that an inner diameter of the passage 1020*a* through the cooperating ring 1110 decreases from a side of the cooperating portion 1180 closer to the first end 1195 of the passage 1020*a* to a side of the cooperating portion 1180 that is away from the first end 1195 of the passage 1020*a*.

In this way, when the collet ring 1105 is inserted into the passage 1020*a* defined by the cooperating ring 1110, then the shaped outer surface portion 1175 of each collet finger 1150 cams off the cooperating portion 1180 of the cooperating member 1110 in order to bend or force the collet fingers 1150 radially inwardly into the passage 1020, 1020*a*, i.e. into pressing engagement with the pipeline or other elongate structure, in use.

The collet ring body 1130 is provided with a circumferential engagement groove 1200 having a radially projecting shoulder 1205 on a side of the engagement groove 1200 that is furthest from the collet fingers 1105. The cooperating ring 1110 is provided with a corresponding engagement projection 1210 that projects from an end of the passage wall 1185 at the first end 1195 of the passage 1020*a*. In this way, when the collet ring 1105 has been correctly inserted into the cooperating ring 1110, then the engagement projection 1210 is received within the engagement groove 1200 of the collet ring body 1130 and an end of the cooperating ring 1110 abuts the shoulder 1205 of the collet ring body 1130.

It will be appreciated that an engagement groove may instead be provided on the cooperating ring 1110 and an engagement projection may be provided on the collet ring 1105. As such, it will be appreciated that the collet ring 1105 and the cooperating ring 1110 need only have interlocking or engaging structures that fix or limit the relative motion of the cooperating ring and the collet ring, without necessarily being limited in the form of the interlocking or engaging structures.

When the engagement projection 1210 is received within the engagement groove 1200 of the collet ring body 1130 and an end of the cooperating ring 1110 abuts the shoulder 1205 of the collet ring body 1130, the collet ring 1105 is retained in the passage 1020*a* of the cooperating ring in a configuration in which the collet fingers 1150 securely grip the pipeline or other elongate structure. The grub or set screws 1145 can be tightened in order to provide additional gripping of the pipeline or other elongate structure and to retain the collet ring 1105 in place.

Since end rings 1015*a*, 1015*b* can be provided at both ends of the packer 1005, it is possible to initially secure a collet ring 1105 of the first end ring 1015*a* in place using the grub screws 1145, then the other components of the packer 1005, such as the cooperating rings 1110, core 1010 and outer seal member 1060, can be mounted in place on the pipeline or other elongate member. The collet ring 1105 of the second end member 1015*b* can then be mounted in place on the pipeline or other elongate member and pressed into the corresponding cooperating ring 1110. Since the collet ring 1105 of the first end ring 1015*a* is secured in position using the grub screws 1145, the compressive force on the collet ring 1105 of the second end ring 1015*b* serves to fully engage both collet rings 1105, 1105 with the corresponding operating rings 1110, 1110. This forces the respective sets of collet fingers 1150 radially inwardly into gripping engagement with the pipeline or other elongate member. The grub screws 1145 of the collet ring 1105 of the second end ring 1015*b* can then be tightened to secure the packer 1005 assembly in the gripping configuration on the pipeline or other elongate structure upon which the packer 1005 is mounted.

The inner seal 1115 is provided between part of the passage wall 1185 of the cooperating ring 1110 and the distal ends 1190 of the collet fingers 1150 in use. In particular, the passage wall 1185 of the cooperating ring 1110 is provided with a further protrusion 1215 that extends radially inwardly from the passage wall 1185 of the cooperating ring 1110 into the passage 1020*a*. The further protrusion 1215 is provided toward a second end 1220 of the passage 1020*a* through the cooperating ring 1110 that is opposite to the first end 1195. An end of the inner seal 1115 abuts a side of the further protrusion 1215 that faces towards the first end 1195 of the passage 1020*a*. As shown in FIGS. 21 to 24, the inner seal 1115 optionally comprises an engaging profile 1225 (e.g. a C-shaped cross section profile) for engaging a corresponding profile of the cooperating ring 1110, e.g. on the further protrusion 1215, in order to secure the inner seal 1115 in place. The inner seal 1115 is compressible between the collet ring 1105 and the cooperating ring 1110 in use in order to seal between the collet ring 1105 and the cooperating ring 1110. Since the collet fingers 1150 are forced into gripping engagement with the pipeline or other elongate structure, the collet fingers 1150 help prevent extrusion of the inner seal 1115 between the end rings 1015*a*, 1015*b* and the pipeline or other elongate structure in use.

Respective ends of the core 1010 extend into the respective second ends 1220 of the passages 1020*a* of respective cooperating rings 1110, 1110 such that the ends of the core 1010 abut a side of the respective further protrusion 1215 that faces towards the second end 1220 of the respective passage 1020*a*. Optionally but not essentially, the core 1010 can be fixed, bonded to or integral with the respective cooperating rings 1110 in order to provide the unitary packer 1005.

Figure 20:
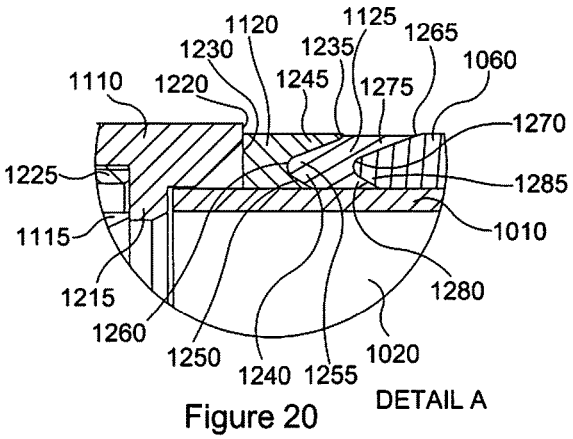
FIG. 20 is a detail side cross sectional view of a part of the seal device of FIGS. 11 and 12.
Figure 21:
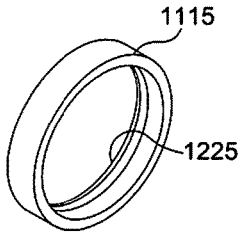
FIG. 21 is a perspective view of an inner seal for use with the collet end ring of FIGS. 13 to 16 and the cooperating ring of FIGS. 17 to 19.
Figure 22:
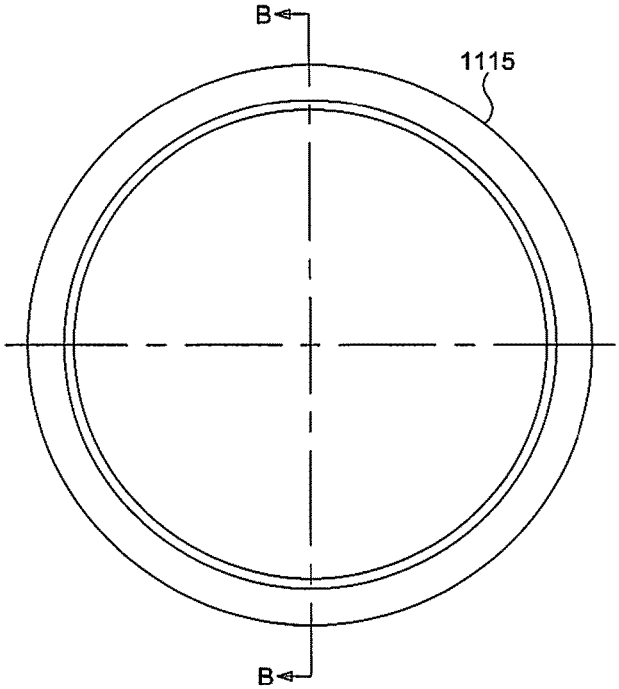
FIG. 22 is en end view of the seal of FIG. 21.
Figure 23:
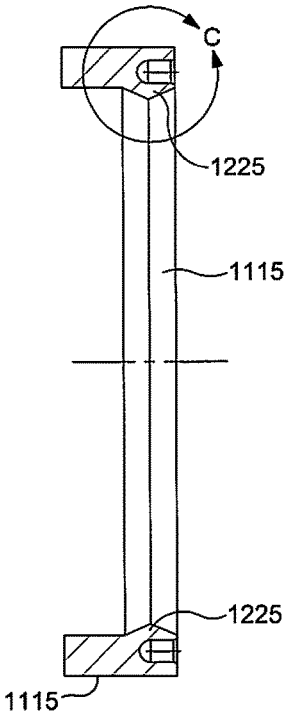
FIG. 23 is a cross section of the seal of FIG. 22 taken through the section B-B in FIG. 22.
Figure 24:
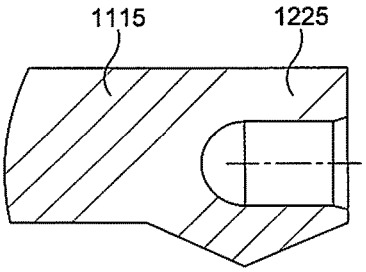
FIG. 24 is detail side cross section view of a part of the seal as shown in area C in FIG. 23.

As shown in FIG. 20, the second end 1220 of the cooperating ring 1110 abuts or is fixed to a first side 1230 of the back-up ring 1120. The first side 1230 of the back-up ring 1120 is shaped to match with the second end 1220 of the cooperating ring 1110, e.g. both surfaces could optionally be planar or have cooperating profiles. The first side 1230 of the back-up ring 1120 is optionally but not essentially bonded or fixed to the second end 1220 of the cooperating ring.

Figure 25:
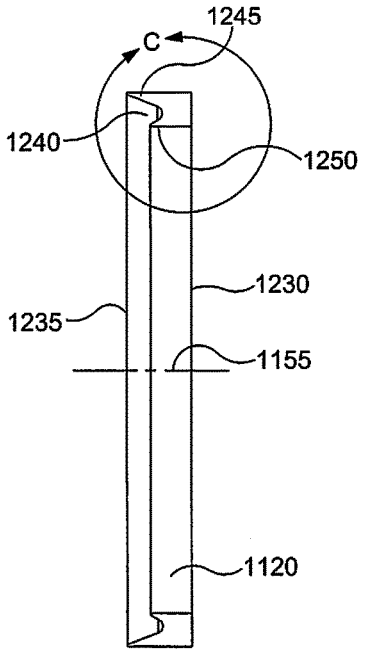
FIG. 25 is a side cross section view of a back-up ring for use in the seal device of FIGS. 11 and 12.
Figure 26:
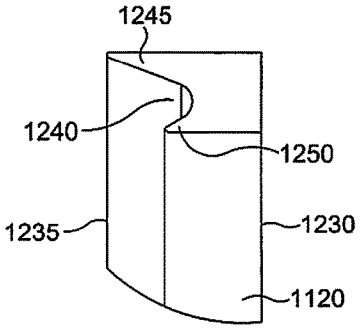
FIG. 26 is a detail view of a part of the back-up ring as shown in area C in FIG. 25.
Figure 27:
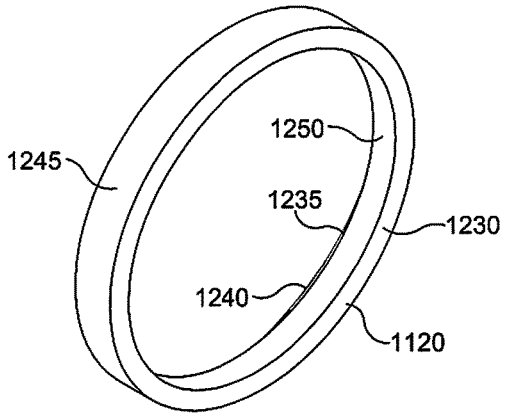
FIG. 27 is a perspective view of the back-up ring of FIGS. 24 to 27.

A second side 1235 of the back-up ring 1120 that is opposite to the first side 1230 is formed with a circumferential groove 1240, as shown in FIGS. 25 to 27. A part 1245 of the back-up ring 1120 on one side, e.g. a radially outer side, of the groove 1240 extends further from the first side 1230 in cross section, as shown in FIGS. 25 and 26, than a part 1250 of the back-up ring 1120 on the other side, e.g. the radially inner side, of the groove 1240. The groove 1240 is configured to receive a corresponding protruding portion 1255 of the support ring 1125.

Figure 28:
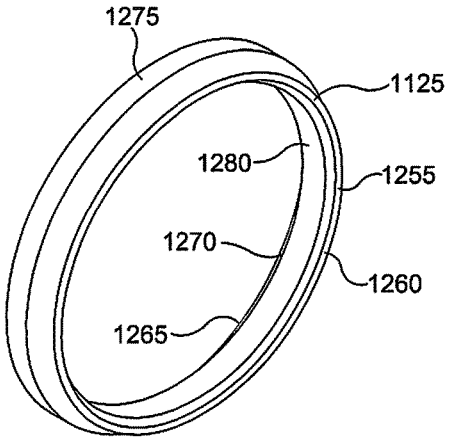
FIG. 28 is a perspective view of a support ring for use in the seal device of FIGS. 11 and 12.
Figure 29:
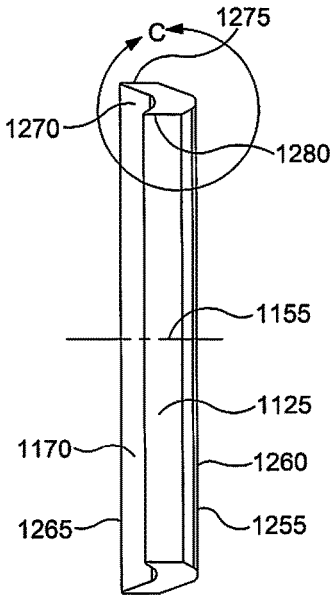
FIG. 29 is a detail view of a part of the support ring of FIG. 28.
Figure 30:
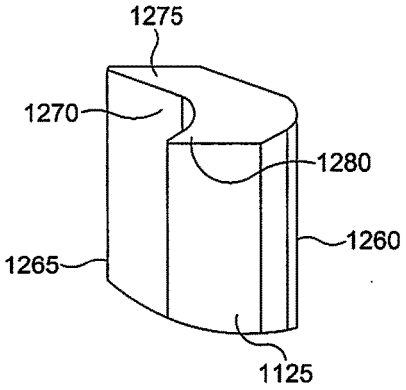
FIG. 30 is a detail view of a part of the support ring shown in area C in FIG. 29.

In particular, the protruding portion 1255 is provided circumferentially around a first side 1260 of the annular support ring 1125, as shown in FIGS. 28 to 30. A second side 1265 of the annular support ring 1125 that is opposite the first side 1260 defines a recess 1270 extending circumferentially around the second side 1265 of the support ring 1125. Similarly to the second side 1235 of the back-up ring 1120, a part 1275 of the support ring 1125 on one side, e.g. a radially outer side, of the recess 1270 extends further from the first side 1260 in cross section, as shown in FIGS. 29 and 30, than a part 1280 of the support ring 1125 on the other side, e.g. the radially inner side, of the recess 1270. The recess 1270 is configured to receive a corresponding protruding portion 1285 of the outer seal member 1060.

The support ring 1125 and the back-up ring 1120 are formed from a deformable material, e.g. an elastomeric material such as Viton.

In this way, when the outer seal member 1060 swells, the protruding portion 1285 of the outer seal member 1060 also swells, forcing the parts 1275, 1280 of the support ring 1125 apart. In this way, the parts 1275, 1280 of the support ring 1125 seal the areas above the support ring 1125, i.e. sealing against the wellbore wall, liner or casing, and below the support ring 1125, i.e. sealing against the core 1010. The more the outer seal member 1060 expands, then the more the parts 1275, 1280 of the support ring 1125 are pushed against the wellbore wall, liner or conduit and the core 1060 respectively. This prevents extrusion of the outer seal member 1060 past the support ring 1125.

A similar mechanism applies to the back-up ring 1120. In this case, as the parts 1275, 1280 of the support ring 1125 are forced further apart, then this applies a force on the back-up ring 1120 in order to force the parts 1245, 1250 of the back-up ring 1120 apart, thereby respectively sealing against the wellbore wall, casing or liner and against the core. In this way, a back-up sealing mechanism to prevent extrusion of the outer seal member 1060 is provided.

It will be appreciated that other variations to the embodiments made above could be made by a person skilled in the art.

For example, whilst the above embodiment describes inserting the collet fingers 1150 into the passage 1020*a* in the cooperating ring 1110 in order to bend the collet fingers 1150 into the gripping configuration, it will be appreciated that the cooperating ring 1110 may equally be inserted onto the collet fingers 1150 in order to achieve the same effect. Indeed, it will be appreciated from the above that the packer 1005 is assembled by first fixing one of the collet rings 1105 onto the pipeline or other elongate structure, e.g. by using the grub screws 1145, then pushing the cooperating ring 1110 onto the collet fingers 1150 to place the collet fingers 1150 into the gripping configuration. The packer 1105 is then then secured in position by pushing the other collet ring 1105 into the other cooperating ring 1110 and tightening the grub screws 1145 on the other collet ring 1105.

In addition, whilst the lock ring 80 in one of the above embodiments is described as comprising a metal toothed band, by way of example, it will be appreciated that the seal device/downhole packer may comprise additional or alternative lock rings or other components, for example, comprising rubber bands, fine wicker threads and the like.

In addition, whilst various embodiments of the packer 5 comprise both inner and outer swellable seals 60, 25*a*, 25*b*, it will be appreciated that other sealing technology or only the inner 60 or outer 25*a*, 25*b* seals could be provided.

In addition, an embodiment is described above in which each end ring 1015*a*, 1015*b* are provided with a plurality of fixing mechanisms in the form of grub screws 1145 and a collet 1105/1110, it will be appreciated that the end rings could instead be provided with other combinations of fixing mechanisms, e.g. types of fixing mechanism, such as two or more of collet rings, grub or set screws and/or one or more lock rings.

Although two support rings or elements, i.e. a support ring and a back-up ring, are described above, it will be appreciated that one, three or more support rings may be used.

The invention claimed is:

1. A downhole seal device, comprising:

a support member;

first and second end members fixed to opposing ends of the support member, the support member and the first and second end members at least partially defining a through passage;

an outer seal mounted on the support member;

at least one collet member configured to selectively grip an elongate structure, the collet member including a plurality of collet fingers configured to fix the downhole seal device to an elongate structure; and at least one inner seal configured to seal against the elongate structure;

wherein one or both of the first and second end members comprises the at least one collet member and a cooperating member, the cooperating member configured to selectively engage the plurality of collet fingers so as to move the collet fingers radially; and wherein the at least one inner seal is provided between at least part of the at least one collet member and at least part of the cooperating member.

2. The seal device according to claim 1, wherein the support member is a rigid member that is rigidly fixed to the first and second end members.

3. The seal device according to claim 1, wherein the seal device is an eccentric seal device.

4. The seal device according to claim 1, wherein at least one of the outer seal and the at least one inner seal comprises a swellable seal.

5. The seal device according to claim 4, wherein at least one of the outer seal and the at least one inner seal is configured to be selectively swellable in a downhole fluid.

6. The seal device according to claim 4, wherein at least one of the outer seal and the at least one inner seal comprises a non-swelling seal.

7. The seal device according to claim 1, wherein the at least one collet member is comprised in one or both of the first and second end members.

8. The seal device according to claim 1, wherein the at least one collet member comprises or is configured to receive one or more threaded members for securing the at least one collet member on the elongate structure.

9. The seal device according to claim 1, comprising one or more deformable support elements between one or both end members and the outer seal.

10. The seal device according to claim 9, wherein the one or more support elements defines a circumferential recess in a face of the support element and a protruding portion of the outer seal and/or at least one other support element is located or receivable in the recess.

11. The seal device according to claim 1, comprising at least one lock device for selectively gripping the elongate structure upon which the seal device is mounted.

12. The seal device of claim 11 wherein the at least one lock device is provided proximate the at least one inner seal.

13. The seal device according to claim 1, wherein an outer diameter of at least one of the end members is greater than the outer diameter of the support member, and at least part of the outer seal is provided between the end members.

14. The seal device according to claim 1, comprising a longitudinally extending line passage configured to carry at least one control line.

* * * * *